US006125833A

United States Patent [19]

Tentler et al.

[11] Patent Number: 6,125,833

[45] Date of Patent: Oct. 3, 2000

[54] WRAP AROUND BOW STRING RELEASE STRAP

[75] Inventors: Lynn A. Tentler; Brian L. Kutz, both of Fond du Lac, Wis.

[73] Assignee: Tru-Fire Corporation, N. Fond du Lac, Wis.

[21] Appl. No.: 09/293,858

[22] Filed: Apr. 16, 1999

[51] Int. Cl.[7] ..... F41B 5/18

[52] U.S. Cl. ..... 124/35.2

[58] Field of Search ..... 124/1, 23.1, 35.2, 124/86

[56] References Cited

U.S. PATENT DOCUMENTS 4,426,989 1/1984 Sutton ..... 124/35.2
4,509,497 4/1985 Garvison ..... 124/35.2
5,261,581 11/1993 Harden ..... 124/23.1 X
5,653,214 8/1997 Lynn ..... 124/35.2
5,857,452 1/1999 Troncoso ..... 124/35.2

*Primary Examiner*—John A. Ricci
*Attorney, Agent, or Firm*—Bracewell & Patterson

[57] ABSTRACT

A bow string release strap assembly is adapted to wrap around the hand while providing maximum freedom of movement for the thumb and protection of the index or trigger finger from a rubbing or chaffing action. The strap assembly includes an integral attachment strap which permits ease of placement and attachment of the strap assembly to the wrist and hand, with a quick release mechanism. The thumb and palm are free and unencumbered and the back of the hand is covered with a soft, cushioned pad providing maximum comfort to the archer. The strap mechanism is adapted for carrying any of large variety of bow string releases.

14 Claims, 2 Drawing Sheets

FIG. 5
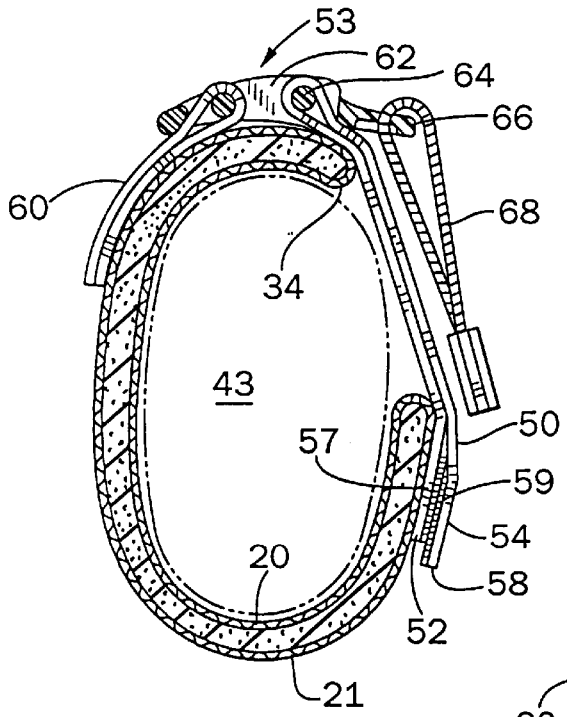
FIG. 4
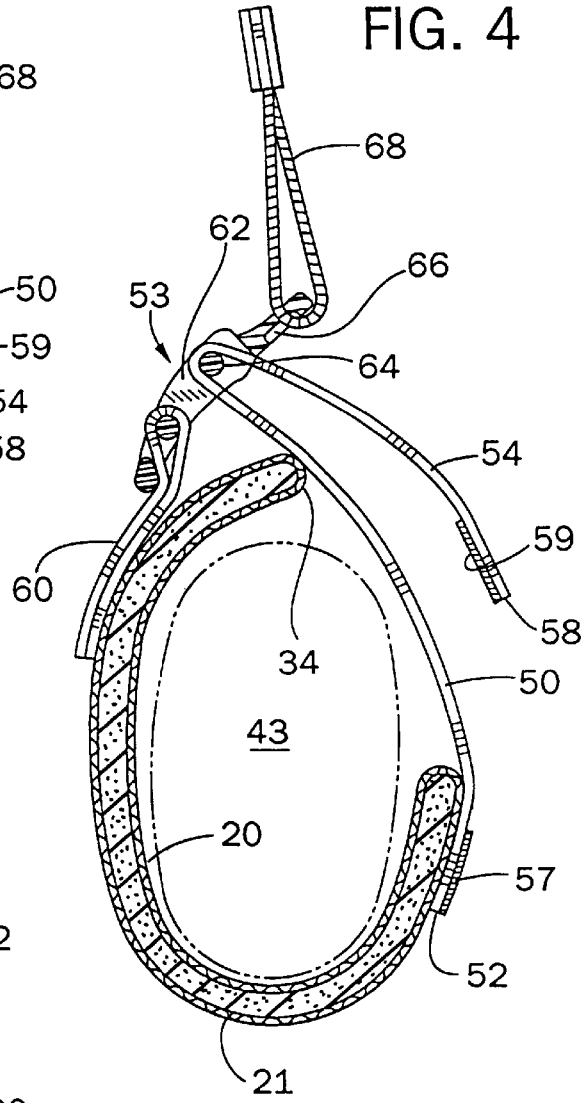
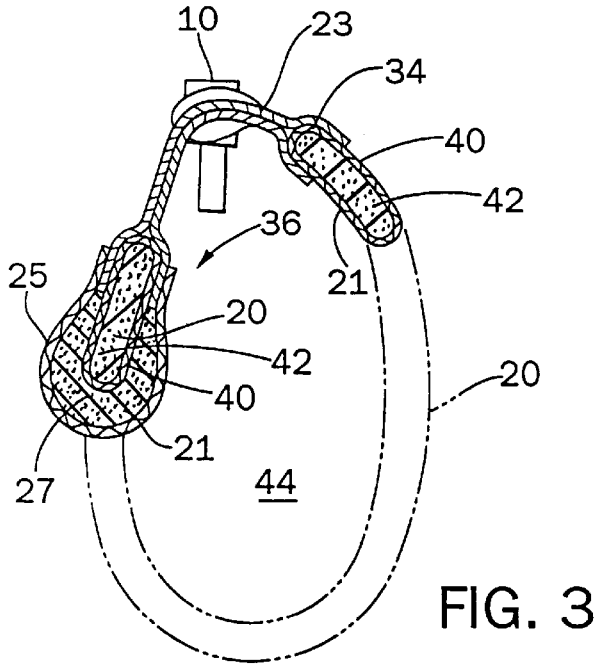
FIG. 3

WRAP AROUND BOW STRING RELEASE STRAP

BACKGROUND OF THE INVENTION

1. Field of the Invention

The subject invention is generally related to straps for securing bow string releases to the wrist and hand of an archer and is specifically directed to a wrap around strap for securing the release to the wrist and hand on either side of the thumb while permitting maximum freedom of movement of the thumb.

2. Discussion of Prior Art

Archery is a sport that continues to grow in popularity. As part of an archer's typical array of eqquipment, the bow string release mechanism has become commonplace. Such releases engage the bow string and secure it as the string is drawn by the archer. When fully drawn, the archer releases the string through the release mechanism. This provides several advantages over the historic method of drawing the string with the hand and fingers. First, as the draw force has increased, with 150 pound bows now common, the strain on the hand and fingers can be substantial. Second, the release can be set to have a standard release stroke and pressure, providing for a more consistent and accurate performance. In addition, properly designed releases reduce the wear and tear on the bow string through repeated use. Also, releases can provide better control of the seating and release of the arrow, enhancing overall accuracy and performance of the archer.

A wide variety of release mechanisms are available, ranging from simple string loop systems to sophisticated caliper mechanisms with calibrated stroke and pressure control devices. A good source of a wide range of information relating to bow string releases in general can be found in the numerous patents to Paul Peck and/or Lynn Tentler, all assigned to Tru-Fire Corporation, the assignee of the subject application.

Many of the release mechanisms are secured to the archer's hand and wrist by means of a wrist strap. This further distributes the forces the archer is subjected to when drawing and releasing the bow string. A number of wrist strap assemblies have been shown and described in patents issued to Paul Peck and/or Lynn Tentler and assigned to Tru-Fire Corporation, the assignee of the subject invention. The prior art straps range from simple wrist loops to sophisticated structures having finger pads, palm pads and quick release wrist straps for providing a release mechanism mounting device that accurately positions the hand for enhancing archer performance while at the same time providing good distribution of the bow string draw forces throughout the hand, wrist and arm to reduce fatigue and increase performance of the archer.

The subject invention is most closely related to wrist straps of the type shown and described in U.S. Pat. No. 4,509,497 issued to Garvison and U.S. Pat. No. 4,426,989 issued to Sutton. Each of these patents shows a bow string release device with an operating release mechanism secured to a strap, with the trigger mechanism attached to a flat, non-stretchable base adapted to be placed in palm of the hand. A finger pad is provided at an outer edge of the base for permitting the archer to wrap the fingers around the base to secure it in the palm. In the best mode of this strap assembly, the base extends up above the palm such that it may be folded over the back of the hand. A thumb hole is provided in the base so that the base can extend beyond the thumb and once wrapped over the top of the hand be secured about the wrist behind the thumb. A releasable strap is secured to the base for securing the strap assembly about the wrist, behind the thumb.

While this strap has been popular over the last several years, it has some significant shortcomings. The thumbhole, by design, restricts movement of the thumb. Also, the base edge behind the thumb hole can press against the thumb, causing discomfort and, after repeated uses, can even lead to chaffing of the skin. Moreover, the front edge of the base can restrict the movement of the index finger, which is usually the trigger finger, and can press against and chafe the skin behind the index finger when the bow is drawn.

Another disadvantage with this design is the difficulty in placing the strap mechanism on and securing it to the hand and wrist. Typically, the archer has to place the base pad in the palm, grasp the finger pad and wrap his fingers around the pad, after which the free hand is used to wrap the pad over the top of the hand and on to the back of the hand as the thumb is placed through the thumb hole. The free hand is then used to grasp the free strap end and place it through and secure it to the buckle also provided on the base. The strap is then tightened and fastened about the wrist.

While the resulting strap has provided favorable results with respect to distribution of force and improvements in consistency and accuracy, it is unwieldy to use and is uncomfortable for the great majority of archers. Therefore, there is a need for a strap assembly that meets or exceeds the force distribution and accuracy improvement capability of the known straps while at the same time providing comfort during use and providing an easier method for securing the strap to the hand and wrist.

SUMMARY OF THE INVENTION

The subject invention provides a novel bow string release strap assembly which is adapted to wrap around the hand while providing maximum freedom of movement for the thumb and protection of the index or trigger finger from a rubbing or chaffing action. In addition the strap assembly of the subject invention includes an integral attachment strap which permits ease of placement and attachment of the strap assembly to the wrist and hand, with a quick release mechanism. It is a feature of the subject invention that the palm is free and the back of the hand is covered with a soft, cushioned pad providing maximum comfort to the archer. The strap mechanism is adapted for carrying any of large variety of bow string releases.

In the preferred embodiment of the strap assembly of the subject invention, the base pad is made of a soft, pliable, but non-stretchable material and is adapted to be placed over the back of the hand instead of primarily on the palm as is the case with prior art assemblies. The finger pad is on the bottom edge of the base pad and is adapted to be grasped by the fingers when the base is properly positioned on the back of the hand.

The base pad and finger pad extend along the length of the hand to the wrist. The palm of the hand remains uncovered and the thumb is unencumbered. A strap is placed at the end of the base and finger pads behind the thumb and closes a loop through which the hand may be inserted in order to mount the strap on the wrist and hand, much in the same manner a glove or mitten is placed on the hand. The strap is simply pulled tight to the individual preference of the archer and secured by a Velcro® type or other friction type fastener.

In the preferred embodiment, the base pad provides a cushioned covering for the index finger, reducing any rubbing or chaffing. The thumb and palm are completely free.

Also in the preferred embodiment, the strap includes a quick release for permitting the strap to be released from the tightened position by one quick movement of the free hand or, for that matter, by grasping the release in the teeth, for example.

The improved strap mechanism of the subject invention provides a comfortable strap assembly with free movement of both the palm and the thumb while at the same time providing a comfortable, non-restrictive wrap for the hand and trigger finger. The strap is easily to mount on the hand and is of both a quick tightening and a quick releasing design.

It is, therefore, an object and feature of the subject invention to provide for a bow string release wrist strap that may be securely and comfortably mounted on the archer's hand and wrist without restricting movement of the thumb.

It is a further object and feature of the subject invention to provide for a strap assembly that is secured at the wrist area without restricting the palm of the archer.

It is yet another object and feature of the subject invention to provide for a comfortable strap assembly that distributes the forces along the back of the hand and the wrist, providing maximum comfort to the archer.

It is an additional object and feature ofthe subject invention to provide for a quick attach and quick release strap assembly.

It is also an object and feature of the subject invention to provide for a strap assembly which may be placed on the archer's hand in the manner of a glove or mitten.

Other objects and features of the invention will be readily apparent from the accompanying drawings and detailed description of the preferred embodiment.

BRIEF DESCRIPTION OF THE DRAWINGS

FIG. 3 is a sectional view looking in the direction of line 3—3.

FIG. 4 is a sectional view looking in the direction of line 4—4.

FIG. 5 is a sectional view looking in the direction of line 5—5.

DETAILED DESCRIPTION OF THE PREFERRED EMBODIMENT

Figure 2:
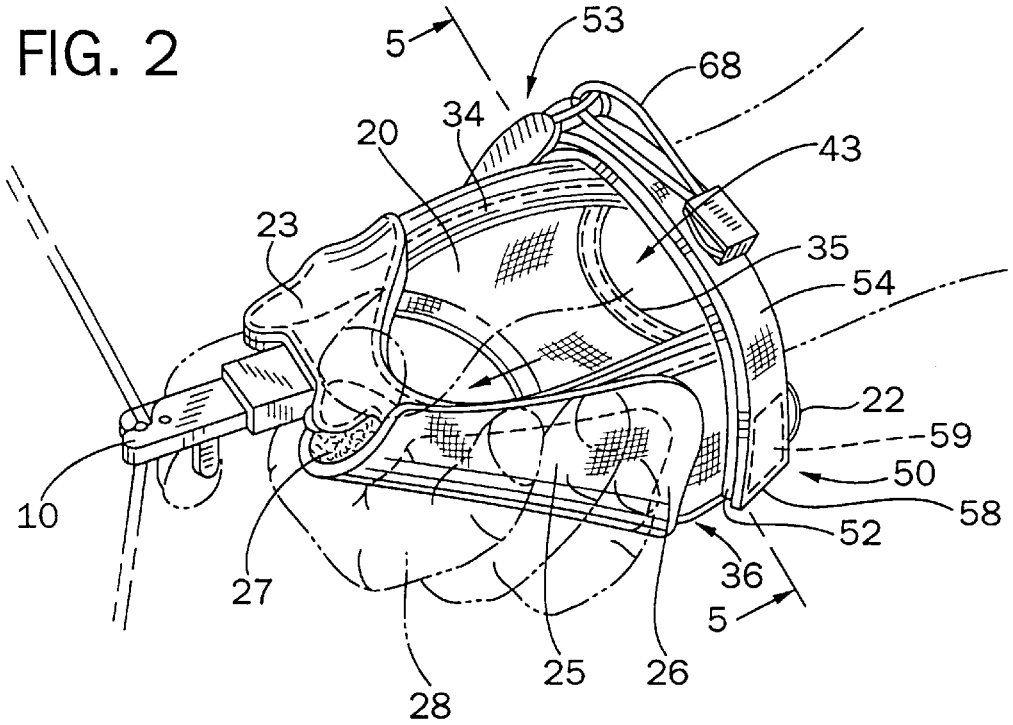
FIG. 2 is a view similar to FIG. 1, showing the hand placed in the strap assembly and the assembly as tightened about the wrist.

As shown in the drawings, the strap mechanism of the subject invention includes a base pad 20 which is adapted for covering the back of the hand (see FIG. 2). The pad 20 has an upper edge 34 (FIG. 3) that covers and extends along the index finger and across the top of the hand, over the thumb and to a rearward or distal end 35 at the wrist of the archer. The lower side of the base pad 20 merges into a finger pad area 36 that extends along the bottom of the hand to a distal end 22, also adjacent the wrist.

Figure 1:
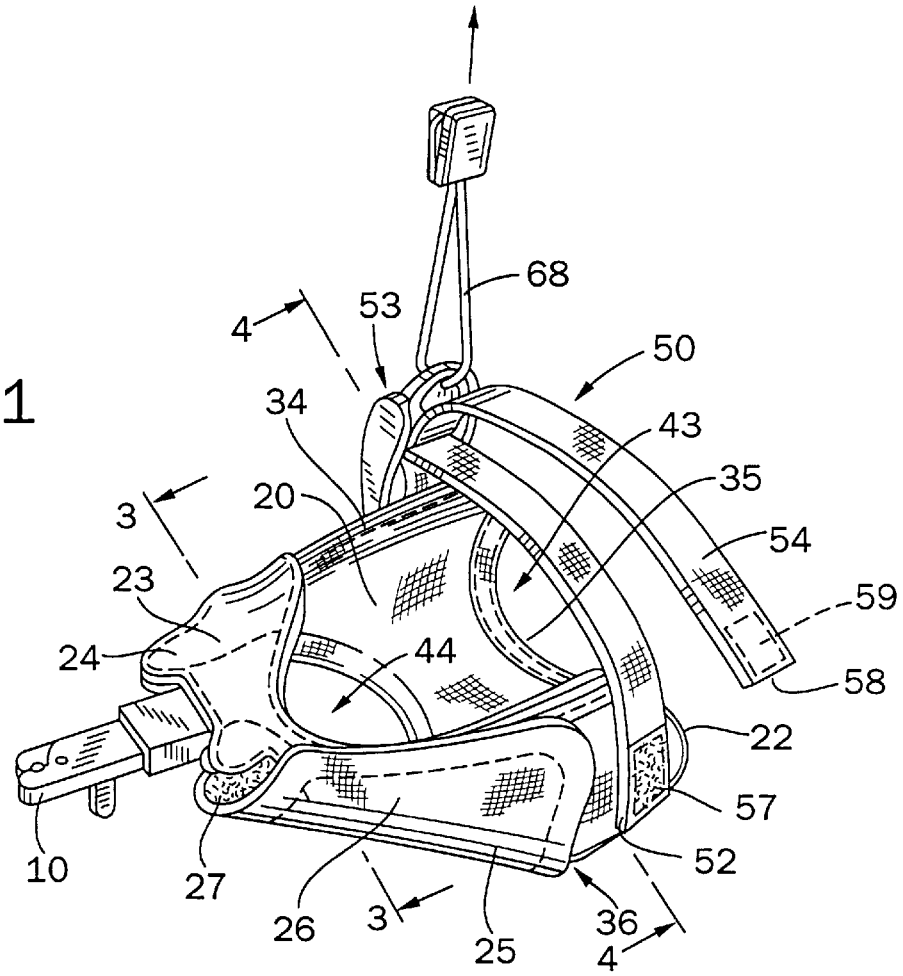
FIG. 1 is a perspective view of the strap assembly of the subject invention.

In the preferred embodiment, the finger pad area includes a cover 25 which is adapted to be grasped by the fingers 28 when the strap is properly positioned on the hand as shown in FIG. 2. It is desirable that the pad 20 be made of a soft, pliable, but non-stretchable material for comfort and to provide a form fit on the back of the hand. The finger pad cover 25 is then adapted to made of a more rigid material to provide for a good, solid finger grip. Where desired, a cushion insert 27 may be provided between the cover 25 and the pad 20 (FIGS. 1 and 3). The base pad material 21 then extends from the finger pad cover 25 to the upper edge 34 of the pad 20 to form the basic structure for the hand area of the strap (see FIG. 3).

Still referring to FIG. 3, the base pad material may be a multiple ply material having a strong outer covering 40 and a soft cushion insert 42 to maximize comfort. With reference to FIG. 1, in the preferred embodiment the various components of the strap are peripherally stitched to one another as at the seam 26. However, other assembly means can be employed as a matter of choice.

A bow string release 10 is secured to the assembly by a release securing pad or bridge 23 which is attached to the base pad 20 as shown at seams 24, see FIG. 1. As also best shown in FIG. 1, an elongated strap 50 has a first end 52 secured to the rear or distal end of the pad 20 behind the finger pad 25. The strap extends up and though a latch assembly 53, with the loose outer end 54 terminating at 58. A Velcro® type fastener assembly comprising pads 57 and 59 are provided on the ends 52 and 58 of the strap 50.

When the strap 50 is fed through the latch 53 as shown in FIGS. 1 and 2 a circular opening 43 is defined. A forward opening 44 is also formed by the top edge 34 of the pad 20, the finger pad 25 and the release securing member 23. As shown in FIG. 2, the hand may be inserted through the hole 43, with the fingers extending through hole or opening 44 and grasping the finger pad 25. The index finger is then free to grasp the trigger of the release 10.

As best shown in FIGS. 4 and 5, the strap may then be secured to the hand and wrist by simply pulling the strap 50 through the latch assembly 53. In the preferred embodiment the latch assembly comprises a base 62 which is secured by a strap 60 to the pad 20. The opposite end of the latch base 62 is secured to the strap 50 by passing the strap 50 over the roller 64, with the outer end 58 of the strap passing through the latch base. This forms a typical over-the-center cinch-type friction latching mechanism that remains tight and secure once cinched. A release tab 66 is provided at the end of the latch base 62 which is opposite the strap 60. A quick release loop 68 is carried in the tab.

Once the strap is mounted on the hand as shown in FIG. 2, the archer will use his free hand to cinch the strap 50, securing the loose end 58 to the secured end 52 of the strap using the Velcro-type hook and loop fastener pads 57 and 59, as shown in FIG. 5. When it is desired to release the strap, the release loop 68 is simply pulled as shown in FIGS. 1 and 4, releasing the cinch latch 52 and loosening the strap 50 such that the hand may be withdrawn through opening 43. The strap assembly retains its circumferential shape so that the strap assembly may be remounted on the hand simply by inserting the hand into the opening 43. It is even possible to tighten and loosen the strap assembly using the teeth, keeping the free hand available for other uses while the strap assembly is either placed on or removed from the hand.

The strap assembly of the subject invention provides a comfortable, circumferential strap with a base covering the back of the hand while maintaining enhanced freedom of movement of the thumb and palm. It may be installed like a glove or mitten and has a quick tighten and quick release latch system. While certain embodiments and features of the invention have been described in detail herein, it will be readily understood that the invention includes all modifications and enhancements within the scope and spirit of the following claims.

What is claimed is:

1. A strap assembly for a bow string release and adapted for securing the release to both the hand and wrist, the strap assembly comprising:

a. a base pad adapted to cover the back of the hand and having opposite edges extending generally along the top and bottom of the hand to an area behind the thumb;

b. a finger pad secured to the bottom ofthe base pad and wrapping around to the front of the hand when place on the hand;

c. a release retaining member between the base pad and the finger pad for securing a release to the assembly, the finger pad, base pad and release retaining member forming a circumferential opening for accommodating the fingers of the hand;

d. a securing mechanism for securing the opposite edges of the base pad to one another in an area behind the thumb.

2. The strap assembly of claim 1, wherein the securing mechanism comprises an elongated strap having opposite ends, one end secured to a first edge of the base pad, and a latch assembly adjacent a second edge of the base pad, with the opposite end of the strap passing through the latch assembly.

3. The strap assembly of claim 2, wherein the latch assembly is a cinch latch and the strap may be tightened about the hand and wrist behind the thumb by pulling and cinching the opposite end of the strap.

4. The strap assembly of claim 3, the cinch latch further including a quick release mechanism whereby the cinch latch frees the cinched strap.

5. The strap assembly of claim 2, wherein the pad and elongated strap form a circumferential opening adapted for accommodating the hand and through which the hand may be inserted in order to place the strap assembly on and in circumscribing relationship with the hand and wrist.

6. The strap assembly of claim 2, further including means for securing the loose outer end of the strap to the pad once the strap assembly is mounted on the hand and wrist.

7. A strap assembly adapted for carrying a bow string release, the strap assembly generally circumscribing the hand and adapted to be secured behind the hand and thumb in a circumscribing relationship with the wrist, the strap assembly comprising;

a. a base pad generally overlying the back of the hand and having a top edge extending generally along the top edge of the hand and a bottom edge extending generally along the bottom edge of the hand;

b. a finger pad secured to the bottom edge of the pad;

c. a release supporting bridge between the finger pad and the base pad;

d. a fastener for securing the top and bottom edges to one another about the wrist behind the thumb.

8. The strap assembly of claim 7, wherein the bridge, finger pad and base pad form a circumferential opening for accommodating the fingers.

9. The strap assembly of claim 8, wherein the upper edge of the base pad extends forward and over the index finger when the fingers are inserted in the circumferential opening.

10. The strap assembly of claim 7, wherein the base pad and fastener form a loop for accommodating the hand and wrist.

11. The strap assembly of claim 7, the base pad comprising a soft resilient, non-stretchable material.

12. The strap assembly of claim 11, the base pad further comprising a multiple ply assembly with a soft cushion insert sandwiched between an outer and inner cover of soft, resilient, non-stretchable material.

13. The strap assembly of claim 7, wherein the bridge is made of a rigid material.

14. The strap assembly of claim 7, wherein the finger pad is made of a rigid material.

* * * * *

UNITED STATES PATENT AND TRADEMARK OFFICE

CERTIFICATE OF CORRECTION

PATENT NO. : 6,125,833
DATED : October 3, 2000
INVENTOR(S) : Tentler et al.

It is certified that error appears in the above-identified patent and that said Letters Patent is hereby corrected as shown below:

Jeffrey A Eckert, North Fond du Lac, WI and James Schiek, Oshkosh, WI are added as inventors.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*

US006125833C1

(12) EX PARTE REEXAMINATION CERTIFICATE (5352nd)

United States Patent

Tentler et al.

(10) Number: US 6,125,833 C1

(45) Certificate Issued: Apr. 18, 2006

(54) WRAP AROUND BOW STRING RELEASE STRAP

(75) Inventors: Lynn A. Tentler, Fond du Lac, WI (US); Brian L. Kutz, Fond du Lac, WI (US); Jeffrey A Eckert, North Fond du Lac, WI (US); James Schiek, Oshkosh, WI (US)

(73) Assignee: Tru-Fire Corporation, North Fond Du Lac, WI (US)

Reexamination Request:
No. 90/006,079, Aug. 10, 2001

Reexamination Certificate for:

| | |
|---|---|
| Patent No.: | **6,125,833** |
| Issued: | **Oct. 3, 2000** |
| Appl. No.: | **09/293,858** |
| Filed: | **Apr. 16, 1999** |

Certificate of Correction issued Jun. 19, 2001.

(51) Int. Cl.
*F41B 5/18* (2006.01)

(52) U.S. Cl. ..... 124/35.2

(58) Field of Classification Search ..... 124/1, 124/23.1, 35.2, 86
See application file for complete search history.

(56) References Cited

U.S. PATENT DOCUMENTS

| | | | |
|---|---|---|---|
| 228,302 | A | 6/1880 | Beard |
| 750,988 | A | 2/1904 | Lotz |
| 1,542,159 | A | 6/1925 | Maxwell |
| 2,000,015 | A | 5/1935 | Flury |
| 2,488,597 | A | 11/1949 | Konold |
| 2,637,311 | A | 5/1953 | Rose |
| 2,819,707 | A | 1/1958 | Kayfes et al. |
| 2,929,372 | A | 3/1960 | Vance |
| 2,936,749 | A | 5/1960 | Chellstorp |
| 2,996,059 | A | 8/1961 | Vance |
| 3,004,532 | A | 10/1961 | Vance |
| 3,028,852 | A | 4/1962 | Sutton, Jr. |
| 3,072,115 | A | 1/1963 | Johnson |
| 3,604,407 | A | 9/1971 | Wilson et al. |
| 3,672,346 | A | 6/1972 | Plumb |
| 3,749,076 | A | 7/1973 | Suski et al. |
| 3,815,908 | A | 6/1974 | Hashimoto |
| 3,845,752 | A | 11/1974 | Barner |
| 3,857,379 | A | 12/1974 | Burghardt |
| 3,873,068 | A | 3/1975 | Allen |
| 3,890,692 | A | 6/1975 | Jandura, Jr. |
| 3,898,974 | A | 8/1975 | Keck |
| 3,921,615 | A | 11/1975 | Dodge |
| 3,948,243 | A | 4/1976 | Gazzara, Sr. |
| 3,954,095 | A | 5/1976 | Lewis |
| 3,998,202 | A | 12/1976 | Boyko |
| 4,004,564 | A | 1/1977 | Castonguay |
| 4,009,703 | A | 3/1977 | Cunningham, Sr. |
| 4,036,204 | A | 7/1977 | Scott |

(Continued)

OTHER PUBLICATIONS

TRU Ball Release Products catalog (not dated).
TRU Ball Release Products catalog, 1997, p. 4.
TRU Ball Release Products catalog (not dated).
HHA Sports 1997 Archery catalog.
"T.R.U. Ball Release Products" catalog, 1996; p. 6.
"HHA Sports 1997 Archery Catalog", 1997; pp. 8, 9.
"T.R.U. Ball Release Products" catalog, 1998; p. 4.

*Primary Examiner*—John A. Ricci

(57) ABSTRACT

A bow string release strap assembly is adapted to wrap around the hand while providing maximum freedom of movement for the thumb and protection of the index or trigger finger from a rubbing or chaffing action. The strap assembly includes an integral attachment strap which permits ease of placement and attachment of the strap assembly to the wrist and hand, with a quick release mechanism. The thumb and palm are free and unencumbered and the back of the hand is covered with a soft, cushioned pad providing maximum comfort to the archer. The strap mechanism is adapted for carrying any of large variety of bow string releases.

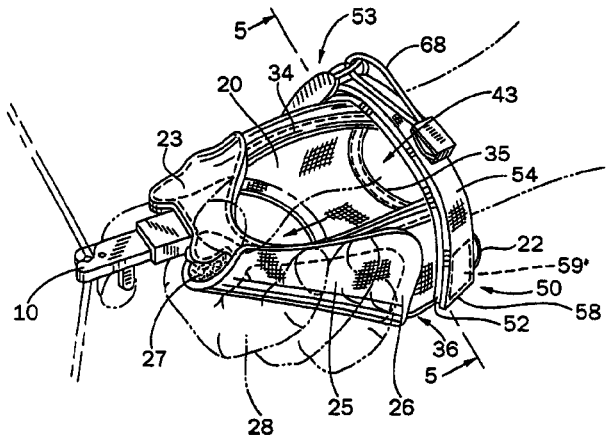

U.S. PATENT DOCUMENTS

| | | | |
|---|---|---|---|
| 4,041,926 | A | 8/1977 | Troncoso, Jr. et al. |
| 4,047,250 | A | 9/1977 | Norman |
| 4,062,339 | A | 12/1977 | Wilson |
| 4,066,060 | A | 1/1978 | Napier |
| 4,083,348 | A | 4/1978 | Fletcher |
| 4,105,011 | A | 8/1978 | Chism |
| 4,151,825 | A | 5/1979 | Cook |
| 4,160,437 | A | 7/1979 | Fletcher |
| 4,193,135 | A | 3/1980 | Rhee |
| 4,249,507 | A | 2/1981 | Marra |
| 4,257,386 | A | 3/1981 | Gazzara |
| 4,282,851 | A | 8/1981 | Lyons |
| 4,308,851 | A | 1/1982 | Kaine, Jr. et al. |
| 4,316,443 | A | 2/1982 | Giacomo |
| 4,392,475 | A | 7/1983 | Fletcher |
| 4,403,594 | A | 9/1983 | Todd |
| 4,407,260 | A | 10/1983 | Lyons |
| 4,426,989 | A | 1/1984 | Sutton |
| 4,476,845 | A | 10/1984 | Rickard |
| 4,485,798 | A | 12/1984 | Hamm |
| 4,489,705 | A | 12/1984 | Larson |
| 4,509,497 | A | 4/1985 | Garvison |
| 4,527,536 | A | 7/1985 | Smith |
| 4,567,875 | A | 2/1986 | Fletcher |
| 4,574,767 | A | 3/1986 | Gazzara |
| 4,584,983 | A | 4/1986 | Ament |
| 4,603,676 | A | 8/1986 | Luoma |
| 4,620,523 | A | 11/1986 | Peck |
| 4,625,705 | A | 12/1986 | Willits |
| 4,674,469 | A | 6/1987 | Peck |
| 4,691,683 | A | 9/1987 | Peck |
| 4,722,319 | A | 2/1988 | Brady |
| 4,791,908 | A | 12/1988 | Pellis |
| 4,831,997 | A | 5/1989 | Greene |
| 4,854,293 | A | 8/1989 | Roberts |
| 4,860,720 | A | 8/1989 | Todd |
| 4,881,516 | A | 11/1989 | Peck |
| 4,909,232 | A | 3/1990 | Carella |
| 4,926,835 | A | 5/1990 | Peck |
| 4,930,485 | A | 6/1990 | Kopper |
| 4,938,487 | A | 7/1990 | Ponsart |
| 4,949,698 | A | 8/1990 | Burnham |
| 4,969,448 | A | 11/1990 | Beyer |
| 4,981,128 | A | 1/1991 | Garvison |
| 4,982,718 | A | 1/1991 | Hamm et al. |
| 5,009,214 | A | 4/1991 | Wilde |
| 5,014,689 | A | 5/1991 | Meunchen et al. |
| 5,020,508 | A | 6/1991 | Greene, Jr. |
| 5,027,786 | A | 7/1991 | Peck |
| D320,254 | S | 9/1991 | Peck |
| 5,067,472 | A | 11/1991 | Vogel et al. |
| 5,070,854 | A | 12/1991 | Peck |
| 5,076,251 | A | 12/1991 | Peck |
| 5,078,116 | A | 1/1992 | Peck |
| 5,103,796 | A | 4/1992 | Peck |
| 5,170,771 | A | 12/1992 | Peck |
| 5,261,581 | A | 11/1993 | Harden, Sr. |
| 5,263,466 | A | 11/1993 | Peck |
| 5,307,788 | A | 5/1994 | Peck |
| 5,318,004 | A | 6/1994 | Peck |
| 5,318,005 | A | 6/1994 | Mayer |
| 5,323,754 | A | 6/1994 | Pittman et al. |
| 5,357,939 | A | 10/1994 | Tentler et al. |
| 5,359,983 | A | 11/1994 | Peck |
| 5,364,148 | A | 11/1994 | Bartocci |
| 5,370,102 | A | 12/1994 | Peck |
| 5,417,197 | A | 5/1995 | Bankstahl |
| 5,448,983 | A | 9/1995 | Scott |
| 5,544,926 | A | 8/1996 | Ravencroft |
| 5,558,077 | A | 9/1996 | Linsmeyer |
| 5,564,407 | A | 10/1996 | Linsmeyer |
| 5,582,158 | A | 12/1996 | Linsmeyer |
| 5,595,167 | A | 1/1997 | Scott |
| 5,596,977 | A | 1/1997 | Scott |
| 5,615,662 | A | 4/1997 | Tentler et al. |
| 5,653,213 | A | 8/1997 | Linsmeyer |
| 5,653,214 | A | 8/1997 | Lynn |
| 5,680,851 | A | 10/1997 | Summers |
| 5,680,852 | A | 10/1997 | Tentler et al. |
| 5,685,286 | A | 11/1997 | Summers |
| 5,715,805 | A | 2/1998 | Summers et al. |
| 5,765,536 | A | 6/1998 | Scott |
| 5,803,068 | A | 9/1998 | Summers |
| 5,850,825 | A | 12/1998 | Scott |
| 5,850,827 | A | 12/1998 | Peck |
| 5,857,452 | A | 1/1999 | Troncoso |
| 5,941,225 | A | 8/1999 | Tentler et al. |
| 5,957,741 | A | 9/1999 | Evans ..... 441/75 |
| 6,032,661 | A | 3/2000 | Goff et al. |
| 6,058,919 | A | 5/2000 | Davis |
| 6,058,920 | A | 5/2000 | Tentler |
| 6,125,833 | A | 10/2000 | Tentler et al. |
| 6,173,706 | B1 | 1/2001 | McConnell |
| 6,173,707 | B1 | 1/2001 | Howell et al. |
| 6,205,991 | B1 | 3/2001 | Summers et al. |
| 6,213,113 | B1 | 4/2001 | Groover et al. |
| 6,237,584 | B1 | 5/2001 | Sims |
| 6,247,467 | B1 | 6/2001 | Siegfried |
| 6,253,753 | B1 | 7/2001 | Blum et al. |
| 6,302,093 | B1 | 10/2001 | Holland |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–14 is confirmed.

Claim 1 is determined to be patentable as amended.

Claims 2–6, dependent on an amended claim, are determined to be patentable.

New claims 15–18 are added and determined to be patentable.

1. A strap assembly for a bow string release and adapted for securing the release to both the hand and wrist, the strap assembly comprising:

a. a base pad adapted to cover the back of the hand and having opposite edges extending generally along the top and bottom of the hand to an area behind the thumb;

b. a finger pad secured to the bottom [ofthe] *of the* base pad and wrapping around to the front of the hand when place*d* on the hand;

c. a release retaining member between the base pad and the finger pad for securing a release to the assembly, the finger pad, base pad and release retaining member forming a circumferential opening for accommodating the fingers of the hand;

d. a securing mechanism for securing the opposite edges of the base pad to one another in an area behind the thumb.

*15. A strap assembly for a bow string release and adapted for securing the release to both the hand and wrist, the strap assembly comprising:*

*a. a base pad adapted to cover the back of the hand and having first opposite edges extending generally along the top and bottom of the hand to an area behind the thumb and having second opposite edges generally proximate to both sides of an inside of the wrist;*

*b. a finger pad secured to the base pad and wrapping around to the front of the hand when placed on the hand;*

*c. a securing mechanism for securing the second opposite edges of the base pad to one another in an area behind the thumb;*

*d. a release retaining member between the base pad and the finger pad for securing a release to the assembly, the finger pad and base pad, the securing mechanism and release retaining member forming a circumferential opening for accommodating the thumb of the hand.*

*16. The strap assembly of claim 1, wherein the finger pad is fixedly secured to the base pad.*

*17. The strap assembly of claim 7, wherein the finger pad is fixedly secured to the base pad.*

*18. The strap assembly of claim 7, wherein the release supporting bridge is fixedly secured to the base pad.*

* * * * *